US006118964A

United States Patent [19]

Kojima et al.

[11] Patent Number: 6,118,964

[45] Date of Patent: Sep. 12, 2000

[54] MULTI-FUNCTIONAL CONTACT-TYPE CHARGING UNIT AND IMAGE TRANSFER UNIT

[75] Inventors: Narihito Kojima; Hiroshi Nagame, both of Shizuoka; Ryuta Takeichi, Kanagawa; Yukiko Iwasaki, Kanagawa; Akiyo Nakajima, Kanagawa; Hiroyuki Fushimi, Shizuoka, all of Japan

[73] Assignee: Ricoh Company, Ltd., Tokyo, Japan

[21] Appl. No.: 09/208,857

[22] Filed: Dec. 10, 1998

[30] Foreign Application Priority Data

Dec. 10, 1997 [JP] Japan ..... 9-356341

[51] Int. Cl.[7] ..... G03G 15/02

[52] U.S. Cl. ..... 399/174; 361/225

[58] Field of Search ..... 399/174–176, 399/313, 314; 361/225

[56] References Cited

U.S. PATENT DOCUMENTS

| | | | |
|---|---|---|---|
| 5,264,903 | 11/1993 | Nagame et al. . | |
| 5,390,015 | 2/1995 | Nagame et al. . | |
| 5,452,061 | 9/1995 | Kojima et al. . | |
| 5,606,408 | 2/1997 | Yano et al. . | |
| 5,619,311 | 4/1997 | Kurokawa et al. | 399/176 |
| 5,619,316 | 4/1997 | Shoji et al. . | |
| 5,812,919 | 9/1998 | Takano et al. | 399/312 |

FOREIGN PATENT DOCUMENTS

| | | |
|---|---|---|
| 56-104351 | 8/1981 | Japan . |
| 57-178267 | 11/1982 | Japan . |
| 58-40566 | 3/1983 | Japan . |
| 58-139156 | 8/1983 | Japan . |
| 58-150975 | 9/1983 | Japan . |
| 63-149668 | 6/1988 | Japan . |
| 6-342236 | 12/1994 | Japan . |
| 7-281503 | 10/1995 | Japan . |
| 8-202226 | 8/1996 | Japan . |
| 9-81001 | 3/1997 | Japan . |
| 10-254295 | 9/1998 | Japan . |

*Primary Examiner*—Richard Moses

*Attorney, Agent, or Firm*—Oblon, Spivak, McClelland, Maier & Neustadt, P.C.

[57] ABSTRACT

A charging or image transfer unit for use in an image formation process including the steps of charging, image formation exposure, image development, image transfer, image fixing and cleaning, for applying an electric field to the surface of an electrophotographic photoconductor by coming into contact therewith, and also for controlling surface properties of the electrophotographic photoconductor. The unit includes an electric field application member applying the electric field to the surface of the electrophotographic photoconductor and a lubricity-imparting member for controlling a friction coefficient of the surface of the electrophotographic photoconductor wherein the electric field application member includes an electrophotoconductive material and a lubricity-imparting member includes a fluoroplastic material.

12 Claims, 4 Drawing Sheets

MULTI-FUNCTIONAL CONTACT-TYPE CHARGING UNIT AND IMAGE TRANSFER UNIT

BACKGROUND OF THE INVENTION

1. Field of the Invention

The present invention relates to a contact-type charging unit and a contact-type image transfer unit for use in an image forming process such as an electrophotographic process using an electrophotographic photoconductor, which can also be employed, for instance, in an electrophotographic copying machine, facsimile apparatus, laser printer, and direct digital printing master making apparatus.

2. Discussion of Background

The electrophotographic process using an electrophotographic photoconductor, which is utilized in electrophotographic copying machine, facsimile apparatus, laser printer and direct digital printing master making apparatus, includes at least the steps of conducting first charging for uniformly charging the surface of the photoconductor, exposing the charged surface of the photoconductor to light images to form latent electrostatic images thereon, developing the latent electrostatic images with toner to make visible toner images, transferring the toner images to a transfer sheet, fixing the toner images to the transfer sheet, and cleaning the surface of the photoconductor.

Charging and image transfer methods in the electrophotographic process can be classified into two methods, that is, a non-contact method and a contact method.

In the non-contact method, an electroconductive member in the form of a wire or a plate, such as a corona charger, is fixed out of contact with the photoconductor in parallel therewith, and a high voltage is applied to the electroconductive member to charge the photoconductor, whereby charging and image transfer are carried out. Of the various conventional methods, this non-contact charging method is in most general use because uniform charging of the surface of the photoconductor can be carried out relatively easily.

In contrast to the above, the charging or image transfer in the contact method is carried out by bringing an appropriate electroconductive, elastic brush, roller-shaped brush, blade or belt into contact with the surface of the photoconductor with the application of a voltage thereto as disclosed in Japanese Laid-Open Patent Applications 63-149668 and 7-281503.

The contact charging or image transfer method is recently becoming very prevalent, because the voltage required to be applied to the photoconductor for conducting the charging or image transfer is lower than that required for the non-contact charging and also because the generation of ozone, which is considered to be chemically harmful to the photoconductor and the human body, is minimal in the course of the charging or image transfer.

In line with the trend toward the personal use of the copying machine, facsimile apparatus and laser printer, there is an increasing demand for the reduction in size of such electrophotographic apparatus and the improvement of durability thereof so as to be free of maintenance.

However, various units are required to be positioned around the photoconductor. Therefore, when the size of a photoconductor is reduced by decreasing the diameter or outer periphery of the photoconductor in order to obtain a small-sized electrophotographic apparatus, there is caused a problem that the arrangement of the units around the photoconductor becomes extremely difficult.

For instance, a technology of disposing around the photoconductor means for supplying a lubricity-imparting agent to the surface of the photoconductor is disclosed in Japanese Laid-Open Patent Applications 6-342236, 8-202226 and 9-81001. It is evident that the disposing of such a peripheral unit around the photoconductor makes it difficult to reduce the size of the apparatus employing the electrophotographic process.

As a photoconductor for use in electrophotography, organic photoconductors are now widely used because of various advantages over other photoconductors, for example, because of low manufacturing cost, high degree of freedom in the designing of the photoconductor, and no pollution problems.

Examples of conventionally known organic photoconductors are photoconductive resin as represented by polyvinylcarbazole (PVK), charge-transport complex type photoconductors as represented by PVK-TNF(2,4,7-trinitrofluorenone), pigment-dispersion type photoconductors as represented by a phthalocyanine-binder photoconductor, and function-separated type photoconductors composed of a charge generation material and a charge transport material in combination. Of these conventional organic photoconductors, special attention is particularly paid to the function-separated type photoconductors.

A mechanism for the formation of latent electrostatic images on the function-separated type photoconductors is such that when the photoconductor is charged and then exposed to light images, the light passes through a transparent charge transport layer and is absorbed by the charge generation material in a charge generation layer, and the charge generation material which absorbs the light generates charge carriers, and the thus generated charge carriers are injected into the charge transport layer and are transported through the charge transport layer in accordance with an electric field which is generated by charging, whereby the charges on the surface of the photoconductor are neutralized. Thus, latent electrostatic images are formed on the surface of the photoconductor.

In such a function-separated type photoconductor, it is conventionally known and considered to be effective to use in combination (a) a charge transport material which exhibits main light absorption in an ultraviolet region and (b) a charge generation material which exhibits main light absorption in a visible region.

Such organic function-separated type photoconductors are extremely useful for reducing the occurrence of defects such as image blurring, and attaining a long life by avoiding the deterioration thereof as caused by the exposure to corona products such as ozone and NOx, when subjected to contact charging with high charging effect and minimal generation of the corona products. In light of these merits, many proposals concerning such organic photoconductors for use in the contact charging have been made, for example, in Japanese Laid-open Patent Application 56-104351, 57-178267, 58-40566, 58-139156 and 58-150975.

However, when such organic photoconductors are subjected to contact charging, several problems including, not only a problem of uneven charging, but also other problems as caused by the physical contact between a charger and the photoconductor, have been pointed out.

Most of the charge transport materials that have been developed are low-molecular weight compounds. Such low-molecular weight compounds, however, do not exhibit film-forming properties when used alone, so that the low-molecular weight compounds are usually used in the form of a dispersion or a mixture with an inert polymer to prepare a charge transport material. The thus prepared charge transport layer comprising the low-molecular weight charge transport material and the inert polymeric material is generally soft and lacking in rigidity, and therefore has a shortcoming that the charge transport layer tends to be peeled off in the course of repeated use in an electrophotographic process. For the achievement of the improvement of the durability of electrophotographic engine, there is a keen demand for the solving the above-mentioned problems.

SUMMARY OF THE INVENTION

It is therefore an object of the present invention to provide a multi-functional charging or image transfer unit for use in an electrophotographic image formation apparatus, from which the above-mentioned conventional shortcomings are eliminated, and which can be reduced in size and has excellent durability in particular when used in combination with an organic electrophotographic photoconductor.

The above-mentioned object of the present invention can be achieved by a charging or image transfer unit for use in an image formation process comprising the steps of charging, image formation exposure, image development, image transfer, image fixing and cleaning, which is capable of applying an electric field to the surface of an electrophotographic photoconductor by coming into contact therewith, and also capable of controlling surface properties of the electrophotographic photoconductor.

In the above charging or image transfer unit of the present invention, the surface properties to be controlled by the charging or image transfer unit include a surface friction coefficient of the electrophotographic photoconductor.

Further, the charging or image transfer unit of the present invention may comprise an electric field application member for applying the electric field to the surface of the electrophotographic photoconductor, and a lubricity-imparting member for controlling the friction coefficient of the surface of the electrophotographic photoconductor.

In the above charging or image transfer unit, the electric field application member may comprise an electroconductive material, and the lubricity-imparting member may comprise a fluoroplastic material.

Furthermore, in the above charging or image transfer unit, the electroconductive material may comprise a fibrous electroconductive material, and the fluoroplastic material may comprise a fibrous fluoroplastic material, thereby constituting a brush structure.

Alternatively, in the above charging or image transfer unit, the electroconductive material may comprise a fibrous electroconductive material, and the fluoroplastic material may comprise a fibrous fluoroplastic material, thereby constituting a felt structure.

Furthermore, the charging or image transfer unit of the present invention may comprise:

electric field application means for applying the electric field to the electrophotogrpahic photoconductor, and lubricating material supplying means for supplying a lubricating material for controlling the surface friction coefficient of the electrophotographic photoconductor to the surface of the electrophotographic photoconductor via the electric field application means.

In the above charging or image transfer unit, the lubricating material supplied to the surface of the electrophotographic photoconductor via the electric field application means may be either a liquid lubricant or a solid lubricant, or a fluoroplastic material.

In the charging or image transfer unit of the present invention, it is preferable that the surface friction coefficient of the electrophotographic photoconductor be controlled to be in a range of 0.4 or less when measured by Euler-belt method.

The above charging or image transfer unit of the present invention may further comprise:

lubricating material supply control means for controlling the amount of the lubricating material to be supplied to the surface of the electrophotographic photoconductor in terms of a coating amount thereof on the surface of the electrophotographic photoconductor by detecting changes in image quality of the image formed on the surface of the electrophotographic photoconductor.

The above charging or image transfer unit may further comprise:

a sensor capable of detecting the changes in image quality of the image as improper development caused by an excessive reduction in the surface friction coefficient of the electrophotographic photoconductor, or capable of detecting output image quality.

The above sensor may be such a sensor that is capable of detecting the changes in image quality of the image as the occurrence of image blurring or image flow caused by the deposition of an ionic com pound on the surface of the electrophotographic photoconductor, or capable of detecting output image quality.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
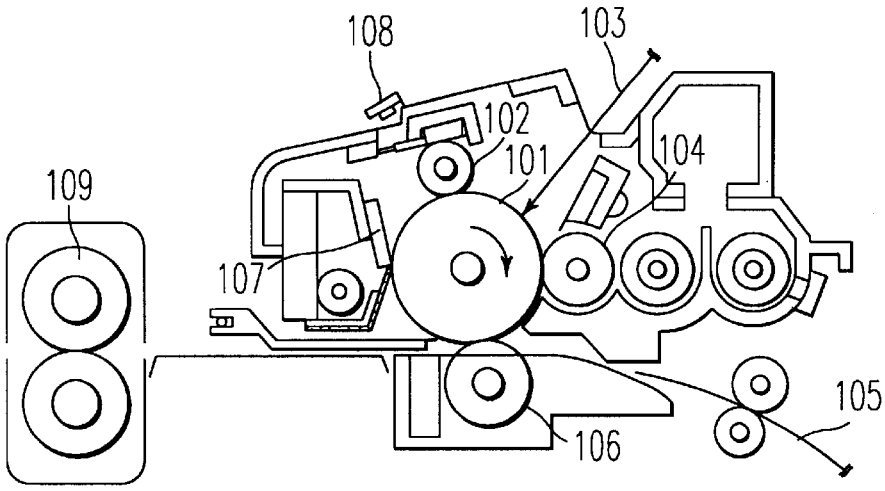
FIG. 1 is a schematic cross-sectional view of an electrophotographic image formation apparatus.

The inventors of the present invention have intensively studied to meet both the requirements for the reduction in size of the electrophotographic image formation apparatus and for the improvement of the durability thereof when the conventional organic photoconductor is used in the conventional electrophotographic process. As a result, it has been discovered that the above can be achieved by an image formation apparatus which uses a multi-functional contact charging or image transfer system, which has not only the charging or image transfer function, but also a function of controlling the surface properties or characteristics of the photoconductor.

Specifically, it has been discovered that by causing a contact charging or image transfer member to have a plurality of functions, the total space required for various units situated around the electrophotographic photoconductor, and new units required for increasing the durability of the photoconductor in the electrophotographic process, can be significantly reduced, and accordingly the size of the image formation apparatus can be reduced in its entirety.

More specifically, by applying a lubricating material to the surface of the photoconductor for maintaining the necessary surface properties or characteristics of the photoconductor for image foramtion, simultaneously with the application of an electric field to the surface of the photoconductor for electrically charging the surface of the photoconductor for the formation of latent electrostatic images thereon, or for electrically charging the surface of the photoconductor for transferring toner images therefrom to a transfer sheet, the deterioration of the photoconductor, for instance, as caused by friction or wearing, can be significantly prevented and accordingly a remarkably durable image formation apparatus can be obtained.

When a photoconductive layer of the photoconducotr is worn or abraded, the electric characteristics of the photoconductor, such as charging performance and light decay performance, are changed, and consequently a desired image forming process cannot be carried out. The result is that the desired image quality in hard copies cannot be maintained.

The abrasion of the photoconductive layer may occur wherever the photoconductor comes in contact with other image formation units disposed around the photoconductor. However, particular attention must be paid to a cleaning unit, such as a cleaning blade or cleaning brush, for physically removing the remaining toner from the surface of the photoconductor. Other units may abrade the surface of the photoconductive layer, but will not have any substantial effect on the actual life of the photoconductor.

The wearing of the photoconductor as caused by the cleaning unit can be classified into two main types. One is caused by a shearing force generated between the photoconductor and a cleaning blade or brush, and the other is caused by a toner which is held between the photoconductor and the blade or brush and works as a grinding stone to abrade the surface of the photoconductor.

The degree of wear of the photoconductor is determined by such factors as (a) the structural strength of the photoconductor, (b) the contact pressure between the photoconductor and the cleaning blade or brush, (c) the composition of toner particles, and (d) the surface friction coefficient ($\mu$). In particular, there is a close correlation among the shear force generated at a contact portion of the photoconductor with the cleaning blade or brush, the surface friction coefficient of the photoconductor, and the abrasion wear of the photoconductor. It is found that the abrasion wear can be minimized by maintaining a minimal surface friction coefficient of the photoconductor.

According to the present invention, by imparting not only a charging function, but also a function of reducing the surface friction coefficient of the photoconductor to the contact charging or contact image transfer member at the same time, the image formation system can be made remarkably compact in size and the abrasion or wear of the photoconductor as otherwise may be caused by the contact of the photoconductor with the cleaning unit can be minimized.

The present invention will now be explained in detail with reference to FIGS. 1 to 12 in the accompanying drawings.

FIG. 1 is a schematic cross-sectional view of an electrophotographic image formation apparatus, comprising a photoconductor drum 101 which is rotated in the direction of the arrow, around which there are disposed a contact-type charging unit 102, an image exposure means 103 of an exposure unit (not shown), a developing unit 104, a contact-type image transfer unit 106, a cleaning unit 107, a quenching lamp 108, and an image fixing unit 109into which a transfer sheet 105 is transported.

The image exposure means 103 may be an image exposure means for carrying out either analogue image exposure or digital image exposure. The analogue image exposure is carried out in such a manner that the photoconductor 101 is exposed to light image reflected by an original document via a lens or a mirror, and in the digital image exposure, electrical signals output from a computer, or electric signals converted from image data obtained by reading an image on an original document with an image sensor such as a charge coupled device (CCD), are reproduced as a light image, using a laser beam or an LED array.

Figure 2:
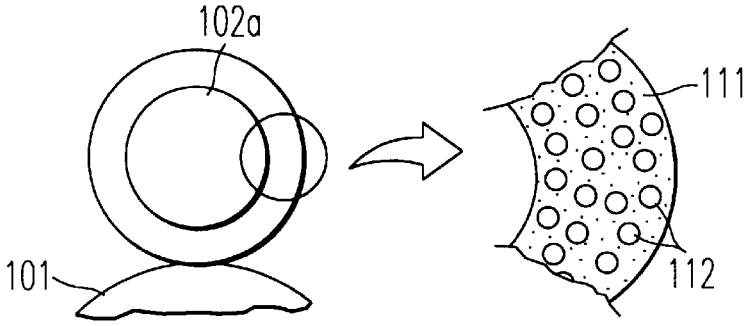
FIG. 2 is an enlarged partially sectional view of an example of a contact-type charging unit 102 of the present invention shown in FIG. 1.

FIG. 2 is an enlarged partially sectional view of an example of the contact-type charging unit 102 shown in FIG. 1, an elastic roller-shaped contact-type charging unit 102*a* of the present invention, which comprises a charging material 111 for applying charges to the surface of the photoconductor 101 and a material 112 for controlling the surface properties of the photoconductor 101.

Figure 3:
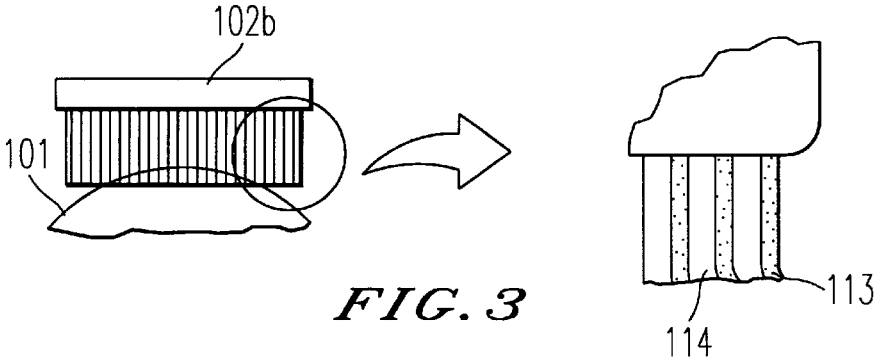
FIG. 3 is an enlarged partially sectional view of another example of the contact-type charging unit 102 of the present invention shown in FIG. 1.

FIG. 3 is an enlarged partially sectional view of another example of the contact-type charging unit 102 shown in FIG. 1, a brush-shaped contact-type charging unit 102*b* of the present invention, which comprises a plurality of different fibers, for example, fibers 113 for applying charges to the surface of the photoconductor 101, and fibers 114 for controlling the surface properties of the photoconductor 101.

Figure 4:
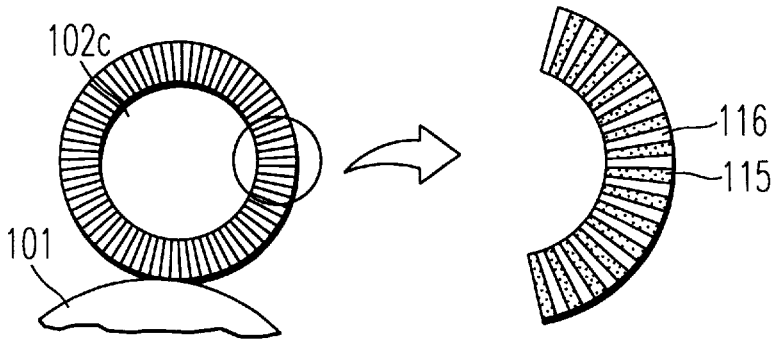
FIG. 4 is an enlarged partially sectional view of a further example of the contact-type charging unit 102 of the present invention shown in FIG. 1.

FIG. 4 is an enlarged partially sectional view of a further example of the contact-type charging unit 102 shown in FIG. 1, a brush-roller-shaped contact-type charging unit 102*c* of the present invention, which comprises fibers 115 for applying charges to the surface of the photoconductor 101, and fibers 116 for controlling the surface properties of the photoconductor 101.

Figure 5:
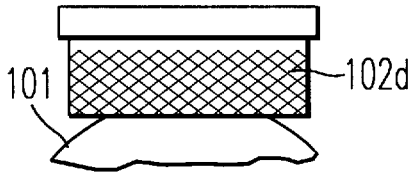
FIG. 5 is an enlarged partially sectional view of still another example of the contact-type charging unit 102 of the present invention shown in FIG. 1.

FIG. 5 is an enlarged partially sectional view of still another example of the contact-type charging unit 102 shown in FIG. 1, a felt-shaped contact-type charging unit 102*d* of the present invention, which comprises a plurality of different kinds of fibers, for example, fibers for applying charges to the surface of the photoconductor 101, and fibers for controlling the surface properties of the photoconductor 101.

Figure 6:
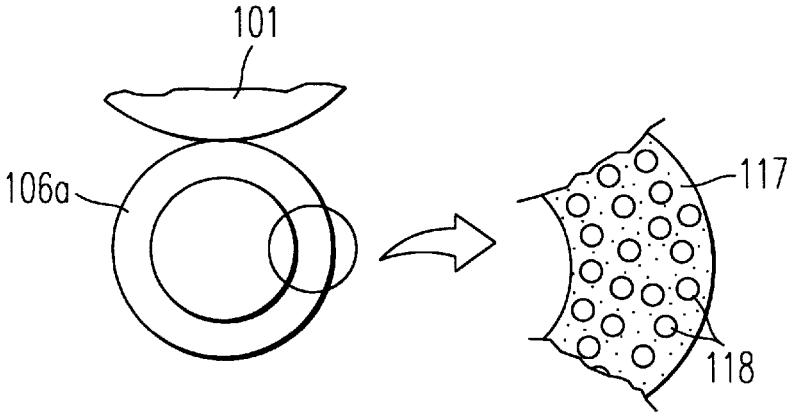
FIG. 6 is an enlarged partially sectional view of an example of a contact-type image transfer unit 106 of the present invention shown in FIG. 1.

FIG. 6 is an enlarged partially sectional view of an example of the contact-type image transfer unit 106 shown in FIG. 1, an elastic roller-shaped contact-type image transfer unit 106*a* of the present invention, which comprises a material 117 for applying charges to the surface of the photoconductor 101, and a material 118 for controlling the surface properties of the photoconductor 101.

Figure 7:
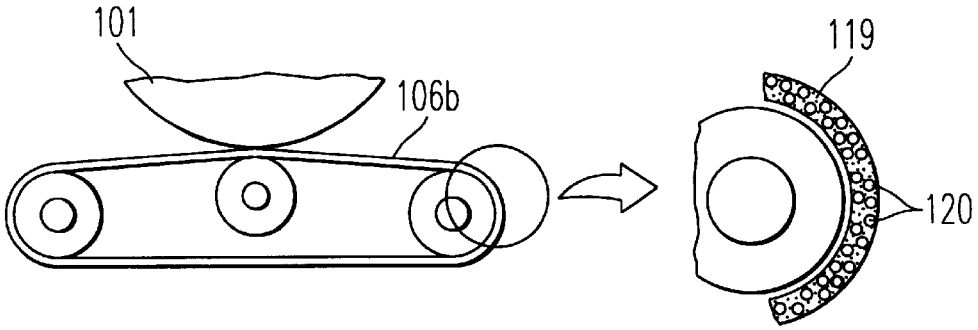
FIG. 7 is an enlarged partially sectional view of an example of the contact-type image transfer unit 106 of the present invention shown in FIG. 1.

FIG. 7 is an enlarged partially sectional view of an example of the contact-type image transfer unit 106 shown in FIG. 1, a belt-shaped contact-type image transfer unit 106*b* of the present invention, which comprises a material 119 for applying charges to the surface of the photoconductor 101, and a material 120 for controlling the surface properties of the photoconductor 101.

Figure 8:
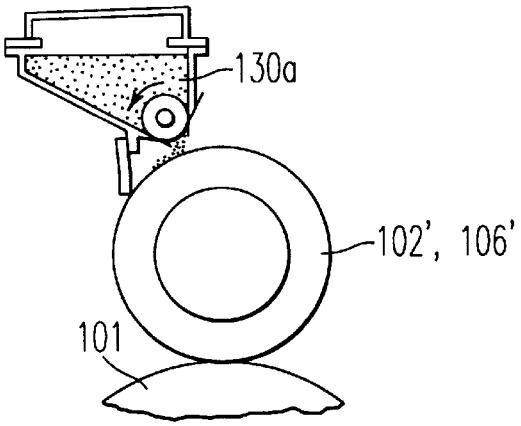
FIG. 8 is an enlarged partially sectional view of a lubricating material supplying unit 130*a* for use in the present invention.

FIG. 8 is an enlarged partially sectional view of a lubricating material supplying unit 130*a* for supplying a powder-like lubricating material for controlling the surface properties such as the surface friction coefficient of the photographic photoconductor via a roller-shaped electric field application member 102' for the contact-type charging unit, or via a roller-shaped electric field application member 106' for the contact-type image transfer unit.

Figure 9:
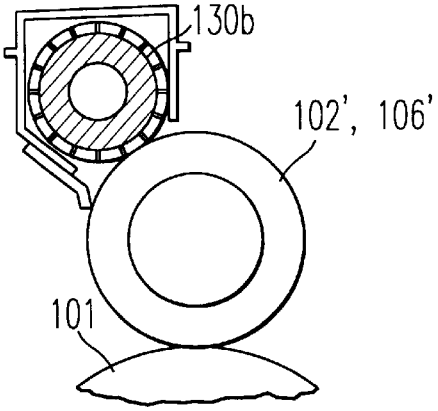
FIG. 9 is an enlarged partially sectional view of a lubricating material supplying unit 130*b* for use in the present invention.

FIG. 9 is an enlarged partially sectional view of a lubricating material supplying unit 130*b* for supplying a liquid lubricating material for controlling the surface properties such as the surface friction coefficient of the photographic photoconductor via a roller-shaped electric field application member 102' for the contact-type charging unit, or via a roller-shaped electric field application member 106' for the contact-type image transfer unit. The lubricating material supply unit 130*b* comprises a roller-shaped member made of a sponge material which is capable of holding the liquid lubricating material and gradually releasing the same therefrom.

Figure 10:
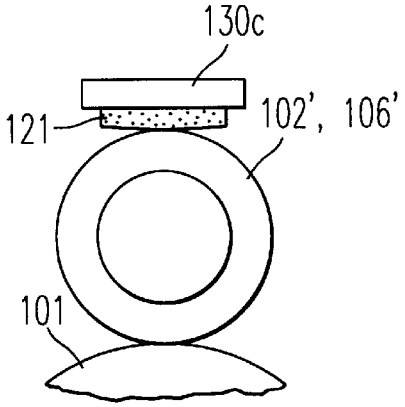
FIG. 10 is an enlarged partially sectional view of a lubricity-imparting member 130*c* for use in the present invention.

FIG. 10 is an enlarged partially sectional view of a lubricity-imparting member 130*c* for controlling the surface properties such as the surface friction coefficient of the photographic photoconductor via a roller-shaped electric field application member 102' for the contact-type charging unit, or via a roller-shaped electric field application member 106' for the contact-type image transfer unit. The lubricity-imparting member 130*c* comprises a solid material which is capable of imparting lubricity to the photographic photoconductor, thereby controlling the surface properties such as the surface friction coefficient of the photographic photoconductor, and is disposed in contact with the roller-shaped electric field application member 102' or the roller-shaped electric field application member 106' as illustrated in FIG. 10.

Figure 11:
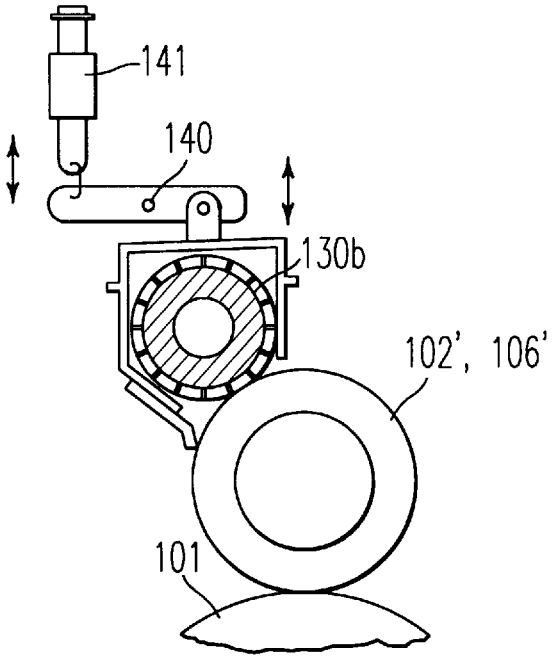
FIG. 11 is an enlarged partially sectional view of the lubricating material supplying unit 130*b* provided with a mechanism for detaching the lubricating material supplying unit 130*b* from a roller-shaped electric field application

FIG. 11 is an enlarged partially sectional view of the lubricating material supplying unit 130*b* for supplying a liquid lubricating material for controlling the surface properties such as the surface friction coefficient of the photographic photoconductor, which is provided with a mechanism for detaching the lubricating material supplying unit 130*b* from the roller-shaped electric field application member 102' or from the roller-shaped electric field application member 106', turning on a fulcrum 140, using, for example, a solenoid 141.

Figure 12:
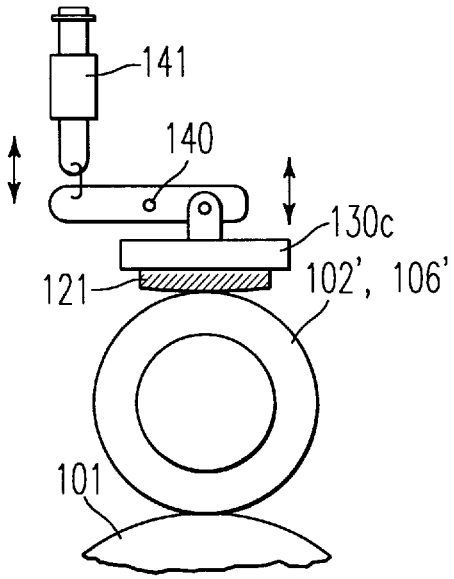
FIG. 12 is an enlarged partially sectional view of the lubricity-imparting member 130*c* provided with a mechanism for detaching the lubricating material supplying unit 130*c* from a roller-shaped electric field application member.

FIG. 12 is an enlarged partially sectional view of the lubricity-imparting member 130*c* for controlling the surface properties such as the surface friction coefficient of the photographic photoconductor via a roller-shaped electric field application member 102' for the contact-type charging unit, or via a roller-shaped electric field application member 106' for the contact-type image transfer unit, which is provided with a mechanism for detaching the lubricating material supplying unit 130*c* from the roller-shaped electric field application member 102' or from the roller-shaped electric field application member 106', turning on a fulcrum 140, using, for example, a solenoid 141.

The contact-type charging unit or the contact-type image transfer unit generally comprises a member, such as an elastic roller, a brush roller, an elastic blade, a brush or a belt, having appropriate electroconductivity, which moves in contact with the surface of the photoconductor and applies a direct current voltage with a predetermined polarity to the surface of the photoconductor, whereby the surface of the photoconductor is maintained at a desired potential or image transfer is performed.

In order to charge the surface of the photoconductor uniformly and efficiently, or to perform toner transfer, such a roller-shaped charging member is brought into contact with the surface of the photoconductor, with a linear speed difference being set between the roller-shaped charging member and the photoconductor. Alternatively, a symmetrical or nonsymmetrical alternating electric field, for instance, in the shape of a sine wave or a pulse wave, is superposed on the direct current voltage applied to the charging member.

Further, in the present invention, in order to uniformly supply the surface of the photoconductor with a material, such as a lubricant, for controlling the surface properties or characteristics of the photoconductor, a brush roller, an elastic roller, a porous elastic roller, a porous elastic blade, a brush or a belt is preferably employed.

To be more specific, a variety of lubricating materials, which may be in the form of a liquid, a solid, or particles, can be used for controlling the surface characteristics including the surface friction coefficient of the photoconductor, and such a lubricating material may be supplied to the surface of the photoconductor via the contact-type charging member or the contact-type image transfer member in the present invention.

Specific examples of the lubricants or lubricating materials for use in the present invention include liquid lubricating materials such as silicone oil and fluorine-containing oil; and solid or powder-like lubricating materials, for example, a variety of fluoroplastics such as polytetrafluoroethylene (PTFE), ethylene tetrafluoride-perfluoroalkyl vinyl ether copolymer resin (PFA) and polyvinylidene fluoride (PVDF), silicone resin, polyolefin resin, silicone grease, fluorine-containing grease, paraffin wax, fatty acid metallic salts such as zinc stearate, graphite, and molybdenum dioxide.

The material of the charging member for use in the contact-type charging unit or the contact-type image transfer unit is required to have appropriate resistivity and also appropriate elasticity to ensure a sufficient contact area between the charging member and the photoconductor in the case where the photoconductor is drum-shaped and free of elastic deformation.

Examples of organic polymeric materials which are in general use, as the materials for such an elastic member for use in the contact-type charging unit or the contact-type image transfer unit, include plastomers (resin materials) and elastomers (rubber materials).

Specific examples of such plastomers and elastomers are as follows: vinyl resins such as polyvinyl chloride, polyvinyl butyral, polyvinyl alcohol, polyvinylidene chloride, polyvinyl acetate, and polyvinyl formal; styrene resins such as polystyrene, styrene-acrylonitrile copolymer, and acrylonitrile-butadiene-styrene copolymer; ethylene resins such as polyethylene, and ethylene-vinyl acetate copolymer; acrylic resins such as polymethyl methacrylate, and polymethyl methacrylate-styrene copolymer; other resin materials such as polyacetal, polyamide, cellulose, polycarbonate, phenoxy resin, polyester, fluoroplastic, polyurethane, phenolic resin, urea resin, melamine resin, epoxy resin, unsaturated polyester resin, and silicone resin; and rubber materials such as natural rubber, isoprene rubber, butadiene rubber, styrene-butadiene rubber, ethylene-propylene rubber, chloroprene rubber, chlorinated polyethylene rubber, epichlorohydrin rubber, nitrile rubber, acrylic rubber, urethane rubber, polysulfide rubber, silicone rubber, fluororubber, and silicone-modified ethylene-propylene rubber.

Specific examples of electroconductivity-imparting materials for use in the charging member are metal powders such as Ni and Cu; carbon blacks such as furnace black, lamp black, thermal black, acetylene black and channel black; electroconductive oxides such as tin oxide, zinc oxide, molybdenum oxide, antimony oxide and potassium titanate; electrolessly plated titanium oxide and electrolessly plated mica; and inorganic fillers and surface active agents such as graphite, metallic fibers and carbon fibers.

These electroconductivity-imparting materials are added to the above-mentioned organic polymers when the organic polymers are electrical insulating materials. It is not always necessary to add such an electroconductivity-imparting material to the organic polymers with a medium resistivity in the range of $10^2$ to $10^{12}$ Ωcm, such as polyamide, chloroprene rubber, epichlorohydrin rubber, nitrile rubber, acrylic rubber and urethane rubber.

The above-mentioned materials are used as the materials for the contact-type charging elastic member or for the contact-type image transfer elastic member, with the resistivity thereof being appropriately adjusted. The charging member may have either a single layer structure or a laminated layer structure, when necessary, or may comprise a composite material with different resistivities for improvement of the properties thereof.

When the charging member or the image transfer member for the contact-type charging unit or for the contact-type image transfer unit is a brush member, as the material for the brush member, synthetic or natural fibers having appropriate electroconductivity can be employed.

To prepare such a brush member, there can be employed resin fibers prepared from resin materials with fiber-forming properties, such as rayon, nylon, acetate, vinylidene, vinylon, polyurethane, polyester, polyethylene, polyvinyl chloride and polypropylene, in which resin fibers a resistivity-controlling agent such as a carbon black, carbon fibers, metallic powder, a metallic oxide or a semiconducting material may be dispersed. The resistivity-controlling agent may be coated on the surfaces of the resin fibers.

A method of controlling the surface friction coefficient of the photoconductor and the necessity for controlling the surface friction coefficient of the photoconductor will now be explained.

When the surface friction coefficient of the photoconductor is reduced by any of the above-mentioned methods, the abrasion wear of the photoconductor can be reduced. In particular, when the surface friction coefficient of the photoconductor, measured by the Euler-belt method, is controlled to be in a range of 0.4 or less, the abrasion of the photoconductor can be effectively prevented.

On the other hand, however, when the friction coefficient of the photoconductor is excessively reduced, the deposition force of toner particles on the surface of the photoconductor is lowered when the latent electrostatic images formed on the photoconductor are developed to visible toner images, using a developing unit. As a result, toner particles cannot be transferred to a desired position on the photoconductor. Such an unfavorable phenomenon tends to occur easily in such a developing system where a latent electrostatic image is developed, in particular, with a two-component developer which comes into contact with the photoconductor.

In the course of the development using such a two-component developer, it may occur that toner particles which have been already transferred to a right image area on the surface of the photoconductor are caused to physically come off from the photoconductor or shifted to an improper position, or a developed toner image is moved in its entirety out of its right position by moving projected ear-shaped portions which are formed in the two-component developer.

The above-mentioned unfavorable phenomenon scarcely occurs when the friction coefficient of the surface layer of the photoconductor is sufficiently high. When the surface friction coefficient of the photoconductor is decreased to less than 0.1, for example, about 0.05, the above-mentioned phenomenon remarkably occurs. This phenomenon becomes a fatal problem with respect to the quality of hard copy images. Therefore, the surface properties of the photoconductor will have to be controlled in such a manner that the surface friction coefficient of the photoconductor does not decrease below a certain level by coating the surface of the photoconductor with some additives.

Furthermore, various materials are deposited on the surface of the photoconductor in the course of the electrophotographic process. Representative examples of such materials are oxidized gases such as ozone, NOx and SOx, which are generated by a discharging process in a charging area or in an image transfer area, and ionic compounds which are produced by composite reactions of the above-mentioned oxidized gases. These compounds thus produced are so hydrophilic that when the compounds are deposited on the surface of the photoconductor, the compounds absorb or trap water molecules in the air. The result is that the electric resistivity of the surface portion of the photoconductor is significantly decreased, so that latent electrostatic images which are optically recorded in the surface of the photoconductor cannot retain the necessary electric charges for maintaining the latent electrostatic images. Therefore, the latent electrostatic images cannot be held on the photoconductor and are impaired.

In practice, however, the above-mentioned harmful materials which are deposited on the photoconductor are removed therefrom by use of a cleaning blade in the cleaning step, so that a serious problem is not caused. However, when the surface friction coefficient of the photoconductor and that of the cleaning blade are excessively decreased, and the shear force generated between the photoconductor and the cleaning blade is excessively lowered, the deposited materials on the photoconductor cannot be easily removed therefrom by the cleaning blade, so that the deposited materials openly cause a serious problem of causing improper development and producing improper images.

Similar to the previously mentioned problem with respect to the developing step, the above-mentioned problem, which occurs in the course of cleaning step, becomes striking when the surface friction coefficient of the photoconductor is decreased to less than 0.1 as measured by the Euler-belt method. For easy removal of the materials deposited on the photoconductor by the cleaning unit, it is preferable to control the amount of the agent for controlling the surface properties of the photoconductor to such a degree that the Similar to the previously mentioned problem with respect to the developing step, the above-mentioned problem, which occurs in the course of cleaning step, becomes striking when the surface friction coefficient of the photoconductor is decreased to less than 0.1 as measured by the Euler-belt method. For easy removal of the materials deposited on the photoconductor by the cleaning unit, it is preferable to control the amount of the agent for controlling the surface properties of the photoconductor to such a degree that the surface friction coefficient of the photoconductor is not extremely decreased.

In the present invention, the surface friction coefficient of the photoconductor is measured by the Euler-belt method as mentioned above. The method of measuring the surface friction coefficient will now be more specifically explained.

A sheet of high quality paper such as copy paper is cut into a belt-shaped paper tape with a predetermined width. The paper tape is brought into contact with the outer surface of a photoconductor drum so as to cover a ¼ peripheral portion of the outer surface of the photoconductor drum in such a configuration that the longitudinal direction of the paper tape is perpendicular to the lengthwise direction of the photoconductor drum. A load of 100 g is applied to one end portion of the paper tape which is directed perpendicularly, while the other end of the paper tape is attached to a tension gauge. Under such a condition that the load remains stationarily hanging from one end of the paper tape, the tension gauge is pulled at a constant speed. The scale of the tension gauge obtained when the paper tape starts to move is read. Then, the friction coefficient ($\mu s$) of the photoconductor drum is obtained in accordance with the following formula:

$$\mu s = 2/\pi \times In(F/W)$$

wherein $\mu s$ is a static friction coefficient, F (g) is a scale value of the tension gauge, and W is a weight (100 g) of the load.

Other features of this invention will become apparent in the course of the following description of exemplary embodiments, which are given for illustration of the invention and are not intended to be limiting thereof.

EXAMPLE 1

[Fabrication of Electrophotographic Photoconductor]

On an aluminum drum with a diameter of 30 mm, an undercoat layer coating liquid with the following formulation was coated and dried, so that an undercoat layer with a thickness of 3.5 $\mu$m was provided on the aluminum drum.

(Formulation for undercoat layer coating liquid)

| | Parts by Weight |
|---|---|
| Alkyd resin (Trademark "BECKOSOL 1307-60-EL" made by Dainippon Ink & Chemicals, Incorporated) | 6 |
| Melamine resin (Trademark "Super Beckamine G-821-60" made by Dainippon Ink & Chemicals, Incorporated) | 4 |
| Titanium oxide | 40 |
| Methyl ethyl ketone | 200 |

On the above prepared undercoat layer, a charge generation layer coating liquid with the following formulation was coated and dried, so that a charge generation layer with a thickness of 0.2 $\mu$m was provided on the undercoat layer.

(Formulation for charge generation layer coating liquid)

| | Parts by Weight |
|---|---|
| Trisazo pigment with the following formula: | 2.5 |
| Polyvinyl butyral (Trademark "XYHL" made by Union Carbide Japan K.K.) | 0.25 |

-continued (Formulation for charge generation layer coating liquid)

| | Parts by Weight |
|---|---|
| Cyclohexanone | 200 |
| Methyl ethyl ketone | 80 |

On the above prepared charge generation layer, a charge transport layer coating liquid with the following formulation was coated and dried, so that a charge transport layer with a thickness of 25 μm was provided on the charge generation layer.

(Formulation for charge transport layer coating liquid)

| | Parts by Weight |
|---|---|
| Bisphenol A-Type polycarbonate (Trademark "Panlite K-1300" made by Teijin Limited) | 10 |
| Methylene chloride | 100 |
| Low-molecular charge transport material with the following formula: | 10 |

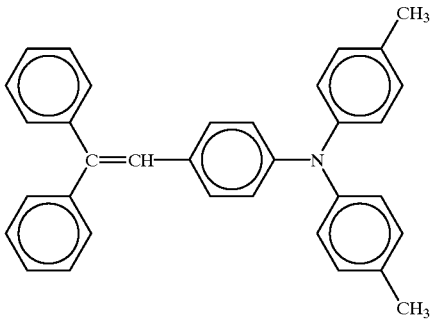

Thus, an electrophotographic photoconductor for use in the present invention was fabricated.

The aforementioned electrophotographic photoconductor was set in an image formation apparatus with a structure as shown in FIG. 1. A charging unit 102*a* in the form of an elastic roller as shown in FIG. 2 was disposed in contact with the photoconductor 101. In a surface portion of the charging unit 102*a* in the form of a roller, finely-divided particles of a commercially available fluoroplastic 112 (Trademark "KTL-8N", made by Kitamura Limited) were dispersed in an electroconductive elastic material 111.

Thus, an image formation apparatus No. 1 for use in the present invention was prepared.

Using the thus prepared image formation apparatus No. 1, 100,000 copies were continuously made. The surface potential (VD) of a dark portion in the photoconductor was preset to 850 V at the initial stage, which surface potential (VD) was measured at the position where the dark portion of the photoconductor reached the developing unit; and the surface potential (VL) of an exposed portion of the photoconductor was preset to 120 V at the initial stage, which surface potential (VL) was measured at the position where the exposed portion of the photoconductor reached the developing unit.

The above-mentioned surface potentials (VD) and (VL), the image quality of the produced image, the surface friction coefficient of the photoconductor, and the abrasion amount were obtained at the initial stage, and after making of 10,000 copies, 50,000 copies and 100,000 copies.

The image quality of the output image was overall evaluated overall on the following scale in terms of the image density of a solid image, the performance of fine line image reproduction, and the occurrence of defective images.

◎: Excellent image quality.

○: Good image quality.

Δ1: A faint striped pattern image was observed.

Δ2: Image blurring was noticeable.

X1: A striped pattern image and other toner deposition on the background were observed.

X2: Image blurring was significant.

The friction coefficient (μs) of a surface portion of the photoconductor was measured by the previously mentioned Euler-belt method.

The abrasion amount (⊿d) was expressed by a decrease in thickness of the photoconductive layer after making of copies.

The results are shown in TABLE 1.

EXAMPLE 2

The procedure for preparation of the image formation apparatus No. 1 in Example 1 was repeated except that the finely-divided particles of the commercially available fluoroplastic 112 (Trademark "KTL-8N", made by Kitamura Limited) for use in the surface portion of the charging unit 102*a* in the form of a roller as employed in Example 1 were replaced by finely-divided particles of a commercially available silicone resin (Trademark "Tospearl 120", made by Toshiba Silicone Co., Ltd.).

Thus, an image formation apparatus No. 2 for use in the present invention was prepared.

The thus prepared image formation apparatus No. 2 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 3

The procedure for preparation of the image formation apparatus No. 1 in Example 1 was repeated except that the charging unit 102*a* in the form of a roller as shown in FIG. 2 in Example 1 was replaced by a charging unit 102*b* in the form of a brush structure as shown in FIG. 3, which was provided with electroconductive fibers 113 and ethylene tetrafluoride resin fibers 114.

Thus, an image formation apparatus No. 3 for use in the present invention was prepared.

The thus prepared image formation apparatus No. 3 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 4

The procedure for preparation of the image formation apparatus No. 1 in Example 1 was repeated except that the charging unit 102*a* in the form of a roller as shown in FIG. 2 in Example 1 was replaced by a charging unit 102*c* in the form of a brush roller as shown in FIG. 4, which was provided with electroconductive fibers 115 and ethylene tetrafluoride resin fibers 116.

Thus, an image formation apparatus No. 4 for use in the present invention was prepared.

The thus prepared image formation apparatus No. 4 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 5

The procedure for preparation of the image formation apparatus No 1 in Example 1 was repeated except that the charging unit 102*a* in the form of a roller as shown in FIG. 2 in Example 1 was replaced by a charging unit 102*d* in the form of a felt as shown in FIG. 5, which was prepared by mixing electroconductive fibers and ethylene tetrafluoride resin fibers.

Thus, an image formation apparatus No. 5 for use in the present invention was prepared.

The thus prepared image formation apparatus No. 5 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 6

The same electrophotographic photoconductor as fabricated in Example 1 was set in an image formation apparatus with a structure as shown in FIG. 1. An image transfer unit 106*a* in the form of an elastic charging roller (hereinafter referred to as an image transfer charging roller) as shown in FIG. 6 was disposed in contact with the photoconductor 101. In a surface portion of the image transfer charging roller 106*a*, finely-divided particles of a commercially available fluoroplastic 118 (Trademark "KTL-8N", made by Kitamura Limited) were dispersed in an electroconductive elastic material 117.

Thus, an image formation apparatus No. 6 for use in the present invention was prepared.

The thus prepared image formation apparatus No. 6 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 7

The procedure for preparation of the image formation apparatus No. 6 in Example 6 was repeated except that the image transfer charging roller 106*a* as shown in FIG. 6 in Example 6 was replaced by an image transfer unit 106*b* in the form of a belt (hereinafter referred to as an image transfer charging belt) as shown in FIG. 7. In a surface portion of the image transfer charging belt, finely-divided particles of a commercially available fluoroplastic 120 (Trademark "KTL-8N", made by Kitamura Limited) were dispersed in an electroconductive material 119.

Thus, an image formation apparatus No. 7 for use in the present invention was prepared.

The thus prepared image formation apparatus No. 7 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 8

The procedure for preparation of the image formation apparatus No. 1 in Example 1 was repeated except that the charging unit 102*a* employed in Example 1 was replaced by the combination of a charging roller 102' and a lubricating material supplying member 130*a* as shown in FIG. 8. The charging roller 102' of which surface portion did not contain any lubricity-imparting material, so that the charging roller 102' served as an electric field application member for applying the electric field to the surface of the photoconductor. The lubricating material supplying member 130*a* was disposed to supply finely-divided particles of a commercially available ethylene tetrafluoride (Trademark "DAIKIN-POLYFLON PTFE Low-Polymer", made by Daikin Industries, Ltd.) to the surface of the photoconductor via the charging roller 102'.

Thus, an image formation apparatus No. 8 for use in the present invention was prepared.

The thus prepared image formation apparatus No. 8 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 9

The procedure for preparation of the image formation apparatus No. 1 in Example 1 was repeated except that the charging unit 102*a* employed in Example 1 was replaced by the combination of a charging roller 102' and a lubricating material supplying member 130*a* as shown in FIG. 8. The charging roller 102' of which surface portion did not contain any lubricity-imparting material, so that the charging roller 102' served as an electric field application member for applying the electric field to the surface of the photoconductor. The lubricating material supplying member 130*a* was disposed to supply finely-divided particles of a commercially available silicone resin (Trademark "KMP590", made by Shin-Etsu Chemical Co., Ltd.) to the surface of the photoconductor via the charging roller 102'.

Thus, an image formation apparatus No. 9 for use in the present invention was prepared.

The thus prepared image formation apparatus No. 9 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 10

The procedure for preparation of the image formation apparatus No. 1 in Example 1 was repeated except that the charging unit 102*a* employed in Example 1 was replaced by the combination of a charging roller 102' and a lubricating material supplying member 130*b* as shown in FIG. 9. The charging roller 102' of which surface portion did not contain any lubricity-imparting material, so that the charging roller 102' served as an electric field application member for applying the electric field to the surface of the photoconductor. The lubricating material supplying member 130*b* which included a sponge roller impregnated with a commercially available slow-volatilizing silicone oil (Trademark "KF50", made by Shin-Etsu Chemical Co., Ltd.) was disposed to supply the above-mentioned silicone oil to the surface of the photoconductor via the charging roller 102'.

Thus, an image formation apparatus No. 10 for use in the present invention was prepared.

The thus prepared image formation apparatus No. 10 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 11

The procedure for preparation of the image formation apparatus No 10 in Example 10 was repeated except that the slow-volatilizing silicone oil used in Example 10 was replaced by a commercially available slow-volatilizing fluorine-containing oil (Trademark "DEMNUM S-100", made by Daikin Industries, Ltd.).

Thus, an image formation apparatus No. 11 for use in the present invention was prepared.

The thus prepared image formation apparatus No. 11 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 12

The procedure for preparation of the image formation apparatus No. 1 in Example 1 was repeated except that the charging unit 102*a* employed in Example 1 was replaced by the combination of a charging roller 102' and a lubricating material supplying member 130*c* as shown in FIG. 10. The charging roller 102' of which surface portion did not contain any lubricity-imparting material, so that the charging roller 102' served as an electric field application member for applying the electric field to the surface of the photoconductor. The lubricating material supplying member 130*c* which included an ethylene tetrafluoride resin in the form of a plate 121 was disposed to supply the above-mentioned ethylene tetrafluoride resin to the surface of the photoconductor via the charging roller 102'.

Thus, an image formation apparatus No. 12 for use in the present invention was prepared.

The thus prepared image formation apparatus No. 12 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 13

The procedure for preparation of the image formation apparatus No. 10 in Example 10 was repeated except that a lubricating material supply control member 141 was further added to the lubricating material supplying member 130*b*. Therefore, the lubricating material supplying member 130*b* was detachable from the charging roller 102' according to a signal from a sensor capable of detecting changes in image quality of an image formed on the surface of the photoconductor.

Thus, an image formation apparatus No. 13 for use in the present invention was prepared.

The thus prepared image formation apparatus No. 13 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 14

The procedure for preparation of the image formation apparatus No. 11 in Example 11 was repeated except that a lubricating material supply control member 141 was further added to the lubricating material supplying member 130*b*. Therefore, the lubricating material supplying member 130*b* was detachable from the charging roller 102' according to a signal from a sensor capable of detecting changes in image quality of an image formed on the surface of the photoconductor.

Thus, an image formation apparatus No. 14 for use in the present invention was prepared.

The thus prepared image formation apparatus No. 14 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

EXAMPLE 15

The procedure for preparation of the image formation apparatus No. 12 in Example 12 was repeated except that a lubricating material supply control member 141 was further added to the lubricating material supplying member 130*c*. Therefore, the lubricating material supplying member 130*c* was detachable from the charging roller 102' according to a signal from a sensor capable of detecting changes in image quality of an image formed on the surface of the photoconductor.

Thus, an image formation apparatus No. 15 for use in the present invention was prepared.

The thus prepared image formation apparatus No. 15 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 1

The procedure for preparation of the image formation apparatus No. 1 in Example 1 was repeated except that the finely-divided particles of the commercially available fluoroplastic 112 (Trademark "KTL-8N", made by Kitamura Limited) were not dispersed in the electroconductive elastic material 111 in the surface portion of the charging unit 102*a* in the form of a roller employed in Example 1.

Thus, a comparative image formation apparatus No. 1 was prepared.

The thus prepared comparative image formation apparatus No. 1 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 2

The procedure for preparation of the image formation apparatus No. 3 in Example 3 was repeated except that the charging unit 102*b* in the form of a brush employed in Example 3 was not provided with the ethylene tetrafluoride resin fibers 114.

Thus, a comparative image formation apparatus No. 2 was prepared.

The thus prepared comparative image formation apparatus No. 2 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 3

The procedure for preparation of the image formation apparatus No. 4 in Example 4 was repeated except that the charging unit 102*c* in the form of a brush roller employed in Example 4 was not provided with the ethylene tetrafluoride resin fibers 116.

Thus, a comparative image formation apparatus No. 3 was prepared.

The thus prepared comparative image formation apparatus No. 3 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 4

The procedure for preparation of the image formation apparatus No. 5 in Example 5 was repeated except that the charging unit 102*d* in the form of a felt employed in Example 5 did not use the ethylene tetrafluoride resin fibers.

Thus, a comparative image formation apparatus No. 4 was prepared.

The thus prepared comparative image formation apparatus No. 4 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 5

The procedure for preparation of the image formation apparatus No. 6 in Example 6 was repeated except that the finely-divided particles of the commercially available fluoroplastic 118 (Trademark "KTL-8N", made by Kitamura Limited) were not dispersed in the electroconductive elastic material 117 in the surface portion of the image transfer charging roller 106*a* employed in Example 6.

Thus, a comparative image formation apparatus No. 5 was prepared.

The thus prepared comparative image formation apparatus No. 5 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

COMPARATIVE EXAMPLE 6

The procedure for preparation of the image formation apparatus No. 7 in Example 7 was repeated except that the finely-divided particles of the commercially available fluoroplastic 120 (Trademark "KTL-8N", made by Kitamura Limited) were not dispersed in the electroconductive material 119 in the surface portion of the image transfer charging belt 106*b* employed in Example 7.

Thus, a comparative image formation apparatus No. 6 was prepared.

The thus prepared comparative image formation apparatus No. 6 was evaluated in the course of making of 100,000 copies in terms of the surface potentials (VD) and (VL), the image quality of the produced image, the surface friction coefficient of the photoconductor, and the abrasion amount in the same manner as in Example 1.

The results are shown in TABLE 1.

TABLE 1

| | At Initial Stage | | | | | After Making of 10,000 Copies | | | | | After Making of 50,000 Copies | | | | | After Making of 100,000 Copies | | | | |
|---|---|---|---|---|---|---|---|---|---|---|---|---|---|---|---|---|---|---|---|---|
| | VD (V) | VL (V) | Image Quality | μs | Δd μm | VD (V) | VL (V) | Image Quality | μs | Δd μm | VD (V) | VL (V) | Image Quality | μs | Δd μm | VD (V) | VL (V) | Image Quality | μs | Δd μm |
| Ex. 1 | 850 | 120 | ◎ | 0.43 | 0 | 830 | 110 | ◎ | 0.25 | 0.3 | 800 | 115 | ◎ | 0.26 | 1.5 | 745 | 120 | Δ1 | 0.28 | 3.3 |
| Ex. 2 | 850 | 120 | ◎ | 0.42 | 0 | 830 | 110 | ◎ | 0.27 | 0.4 | 805 | 110 | ◎ | 0.29 | 1.8 | 750 | 120 | Δ1 | 0.30 | 4.1 |
| Comp. Ex. 1 | 850 | 120 | ◎ | 0.41 | 0 | 805 | 105 | ○ | 0.58 | 1.5 | 610 | 120 | X1 | 0.60 | 6.5 | 540 | 130 | X2 | 0.61 | 12.2 |
| Ex. 3 | 850 | 120 | ◎ | 0.43 | 0 | 835 | 110 | ◎ | 0.24 | 0.3 | 805 | 110 | ◎ | 0.26 | 1.4 | 750 | 120 | X2 | 0.25 | 3.2 |
| Comp. Ex. 2 | 850 | 120 | ◎ | 0.43 | 0 | 800 | 110 | ○ | 0.60 | 1.6 | 600 | 120 | X1 | 0.61 | 6.8 | 550 | 130 | X2 | 0.61 | 13.5 |
| Ex. 4 | 850 | 120 | ◎ | 0.42 | 0 | 835 | 110 | ◎ | 0.18 | 0.2 | 800 | 115 | ◎ | 0.21 | 1.2 | 760 | 120 | ○ | 0.20 | 2.5 |
| Comp. Ex. 3 | 850 | 120 | ◎ | 0.43 | 0 | 795 | 110 | ○ | 0.58 | 1.6 | 605 | 125 | X1 | 0.62 | 7.0 | 545 | 130 | X2 | 0.61 | 13.4 |
| Ex. 5 | 850 | 120 | ◎ | 0.42 | 0 | 835 | 110 | ◎ | 0.26 | 0.5 | 800 | 110 | ◎ | 0.28 | 2.3 | 750 | 120 | Δ1 | 0.30 | 5.1 |
| Comp. Ex. 4 | 850 | 120 | ◎ | 0.41 | 0 | 800 | 110 | ○ | 0.59 | 1.5 | 610 | 120 | X1 | 0.61 | 6.6 | 535 | 130 | X2 | 0.62 | 12.6 |
| Ex. 6 | 850 | 120 | ◎ | 0.44 | 0 | 830 | 110 | ◎ | 0.29 | 0.4 | 790 | 110 | ◎ | 0.32 | 2.6 | 730 | 115 | Δ1 | 0.29 | 5.0 |
| Comp. Ex. 5 | 850 | 120 | ◎ | 0.42 | 0 | 805 | 110 | ○ | 0.60 | 1.6 | 595 | 125 | X1 | 0.65 | 7.5 | 540 | 130 | X2 | 0.66 | 14.8 |
| Ex. 7 | 850 | 120 | ◎ | 0.43 | 0 | 825 | 110 | ◎ | 0.28 | 0.3 | 795 | 110 | ◎ | 0.29 | 2.5 | 735 | 115 | Δ1 | 0.30 | 4.5 |
| Comp. Ex. 6 | 850 | 120 | ◎ | 0.41 | 0 | 800 | 110 | ○ | 0.62 | 1.6 | 600 | 120 | X1 | 0.62 | 7.0 | 540 | 130 | X2 | 0.63 | 14.2 |
| Ex. 8 | 850 | 120 | ◎ | 0.41 | 0 | 840 | 110 | ◎ | 0.12 | 0.1 | 840 | 110 | ○ | 0.08 | 0.3 | 840 | 110 | Δ2 | 0.70 | 0.5 |
| Ex. 9 | 850 | 120 | ◎ | 0.42 | 0 | 845 | 110 | ◎ | 0.13 | 0.1 | 840 | 110 | ○ | 0.09 | 0.2 | 840 | 110 | Δ2 | 0.08 | 0.5 |
| Ex. 10 | 850 | 120 | ◎ | 0.43 | 0 | 840 | 110 | ◎ | 0.10 | 0.1 | 845 | 110 | ○ | 0.08 | 0.3 | 840 | 110 | Δ2 | 0.08 | 0.5 |
| Ex. 11 | 850 | 120 | ◎ | 0.43 | 0 | 840 | 110 | ◎ | 0.10 | 0.1 | 845 | 110 | ○ | 0.08 | 0.2 | 840 | 110 | Δ2 | 0.06 | 0.4 |
| Ex. 12 | 850 | 120 | ◎ | 0.42 | 0 | 845 | 110 | ◎ | 0.11 | 0.1 | 840 | 110 | ○ | 0.08 | 0.2 | 840 | 110 | Δ2 | 0.07 | 0.4 |
| Ex. 13 | 850 | 120 | ◎ | 0.42 | 0 | 840 | 110 | ◎ | 0.10 | 0.1 | 840 | 110 | ◎ | 0.10 | 0.3 | 845 | 110 | ◎ | 0.10 | 0.8 |
| Ex. 14 | 850 | 120 | ◎ | 0.43 | 0 | 840 | 110 | ◎ | 0.10 | 0.1 | 840 | 110 | ◎ | 0.09 | 0.3 | 845 | 110 | ◎ | 0.10 | 0.7 |
| Ex. 15 | 850 | 120 | ◎ | 0.41 | 0 | 840 | 110 | ◎ | 0.12 | 0.1 | 840 | 110 | ◎ | 0.11 | 0.6 | 845 | 110 | ◎ | 0.12 | 0.9 |

As can be seen from the results shown in TABLE 1, when the image formation apparatus comprising the charging or image transfer unit according to the present invention is subjected to repeated electrophotographic processes, deterioration of the organic electrophotographic photoconductor can be minimized in terms of the electrical characteristics such as charging performance and photosensitivity, and the mechanical abrasion of the photoconductive layer. Therefore, high quality of a hard copy image can be maintained over a long period of time.

Furthermore, when the amount of agent capable of controlling the surface properties of the photoconductor is controlled in accordance with the signal from a sensor capable of detecting changes in image quality of an image formed on the surface of the photoconductor, the above-mentioned advantages can be obtained over a longer period of time.

Thus, an image forming apparatus can be made compact, and provided with high durability and high reliability by employing the charging or image transfer unit of the present invention.

Japanese Patent Application No. 09-356341 filed Dec. 10, 1998 is hereby incorporated by reference.

What is claimed is:

1. A charging or image transfer unit for use in an image formation process comprising the steps of charging, image formation exposure, image development, image transfer, and image fixing and cleaning, which includes applying an electric field to the surface of an electrophotographic photoconductor by coming into contact therewith, and controlling surface properties of said electrophotographic photoconductor, said charging or image transfer unit comprising:

an electric field application member for applying said electric field to the surface of said electrophotographic photoconductor, and a lubricity-imparting member for controlling said friction coefficient of the surface of said electrophotographic photoconductor, wherein said electric field application member comprises a fibrous electroconductive material and said lubricity-imparting member comprises a fibrous fluoroplastic material.

2. The charging or image transfer unit as claimed in claim 1, wherein said surface properties to be controlled by said charging or image transfer unit include a surface friction coefficient of said electrophotographic photoconductor.

3. The charging or image transfer unit as claimed in claim 1, wherein said fibrous electroconductive material and said fibrous fluoroplastic material form a brush structure.

4. The charging or image transfer unit as claimed in claim 1, wherein wherein said fibrous electroconductive material and said fibrous fluoroplastic material form a felt structure.

5. The charging or image transfer unit as claimed in claim 2, further comprising:

a lubricating material supplying member for supplying a lubricating material to said lubricity-imparting member.

6. The charging or image transfer unit as claimed in claim 5, wherein said lubricating material supplied to the surface of said electrophotographic photoconductor via said electric field application member comprises a liquid lubricant.

7. The charging or image transfer unit as claimed in claim 5, wherein said lubricating material supplied to the surface of said electrophotographic photoconductor via said electric field application member comprises a solid lubricant.

8. The charging or image transfer unit as claimed in claim 5, wherein said lubricating material supplied to the surface of said electrophotographic photoconductor via said electric field application member comprises a fluoroplastic material.

9. A charging or image transfer unit for us in an image formation process comprising the steps of charging, image formation exposure, image development, image transfer, and image fixing and cleaning, which includes supplying an electric field to the surface of an electrophotographic photoconductor by coming in contact therewith, and controlling surface properties of said electrophotographic photoconductor wherein said surface properties to be controlled by said charging or image transfer unit include a surface friction coefficient of said electrophotographic photoconductor and wherein said surface friction coefficient of said electrophotographic photoconductor is controlled to be in a range of 0.4 or less when measured by a Euler-belt method.

10. The charging or image transfer unit as claimed in claim 5, further comprising:

lubricating material supply control member controlling the amount of said lubricating material to be supplied to the surface of said electrophotographic photoconductor in terms of a coating amount thereof on the surface of said electrophotographic photoconductor by detecting changes in image quality of said image formed on the surface of said electrophotographic photoconductor.

11. A charging or image transfer unit for use in an image formation process comprising the steps of charging, image formation exposure, image development, image transfer, and image fixing and cleaning, which includes supplying an electric field to the surface of an electrophotographic photoconductor by coming in contact therewith, and controlling surface properties of said electrophotographic photoconductor wherein said surface properties to be controlled by said charging or image transfer unit include a surface friction coefficient of said electrophotographic photoconductor, said charging or image transfer unit comprising:

an electric field application member for applying said electric field to said electrophotographic photoconductor, and a lubricating material supplying member for supplying a lubricating material to said lubricity-imparting member;

a lubricating material supplying control member controlling the amount of said lubricating material to be supplied to the surface of said electrophotographic photoconductor in terms of a coating amount thereof on the surface of said electrophotographic photoconductor by detecting changes in image quality of said image formed on the surface of said electrophotographic photoconductor; and a sensor detecting said changes in image quality of said image as improper development caused by an excessive reduction in said surface friction coefficient of said electrophotographic photoconductor, or detecting output image quality.

12. A charging or image transfer unit for use in an image formation process comprising the steps of charging, image formation exposure, image development, image transfer, and image fixing and cleaning, which includes supplying an electric field to the surface of an electrophotographic photoconductor by coming in contact therewith, and controlling surface properties of said electrophotographic photoconductor wherein said surface properties to be controlled by said charging or image transfer unit include a surface friction coefficient of said electrophotographic photoconductor, said charging or image transfer unit comprising:

an electric field application member for applying said electric field to said electrophotographic photoconductor; and a lubricating material supplying member for supplying a lubricating material to said lubricity-imparting member;

a lubricating material supplying control member controlling the amount of said lubricating material to be supplied to the surface of said electrophotographic photoconductor in terms of a coating amount thereof on the surface of said electrophotographic photoconductor by detecting changes in image quality of said image formed on the surface of said electrophotographic photoconductor;

a sensor detecting said changes in image quality of said image as the occurrence of image blurring or image flow caused by the deposition of an ionic compound on the surface of said electrophotographic photoconductor, or detecting output image quality.

* * * * *

UNITED STATES PATENT AND TRADEMARK OFFICE

CERTIFICATE OF CORRECTION

PATENT NO. : 6,118,964

DATED : September 12, 2000

INVENTOR(S): Narihito KOJIMA, et al.

It is certified that an error appears in the above-identified patent and that said Letters Patent is hereby corrected as shown below:

Col. 5, line 2, after "application" insert --member.-- line 32, change "foramtion" to --formation--.

line 43, change "photoconducotr" to --photoconductor--.

Col. 11, line 4, delete "that the", insert --.--.

Col. 14, line 13, delete "overall".

Table 1, Ex. 8, change "0.70" to --0.07--.

line 48, delete second occurrence of "wherein".

line 66, change "us" to --use--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*